US010843836B2

(12) United States Patent
Bouveret

(10) Patent No.: US 10,843,836 B2
(45) Date of Patent: Nov. 24, 2020

(54) ANTI-DEPRESSION PLASTIC CONTAINER

(71) Applicant: NORTH AMERICA I.M.L. CONTAINERS, St-Placide (CA)

(72) Inventor: Nicolas Bouveret, Mirabel (CA)

(73) Assignee: NORTH AMERICA I.M.L. CONTAINERS, St-Placide (CA)

( * ) Notice: Subject to any disclaimer, the term of this patent is extended or adjusted under 35 U.S.C. 154(b) by 678 days.

(21) Appl. No.: 14/812,442

(22) Filed: Jul. 29, 2015

(65) Prior Publication Data

US 2016/0031593 A1 Feb. 4, 2016

Related U.S. Application Data

(60) Provisional application No. 62/032,075, filed on Aug. 1, 2014.

(51) Int. Cl.

| | |
|---|---|
| ***B65D 1/02*** | (2006.01) |
| ***B65B 61/24*** | (2006.01) |
| ***B65B 7/28*** | (2006.01) |
| ***B65D 21/02*** | (2006.01) |
| ***B65D 79/00*** | (2006.01) |
| ***B65D 1/26*** | (2006.01) |
| ***B65D 51/18*** | (2006.01) |

(52) U.S. Cl.

CPC ..... *B65B 61/24* (2013.01); *B65B 7/28* (2013.01); *B65D 1/26* (2013.01); *B65D 21/0233* (2013.01); *B65D 51/18* (2013.01); *B65D 79/005* (2013.01); *B65D 2251/0018* (2013.01); *B65D 2251/0093* (2013.01)

(58) Field of Classification Search

CPC ..... B65D 1/0261; B65D 6/16; B65D 11/14; B65D 11/18; B65D 21/0233; B65D 79/005; B65D 11/20; B65B 7/28; B65B 61/24

USPC ..... 220/603, 604, 606, 609, 610, 623, 608, 220/624; 53/471; 215/371–373

See application file for complete search history.

(56) References Cited

U.S. PATENT DOCUMENTS 2,971,671 A * 2/1961 Shakman ..... B65D 7/04 220/609
2,982,440 A * 5/1961 Harrison ..... B65D 1/265 220/609
3,409,167 A * 11/1968 Blanchard ..... B65D 79/005 220/609
3,426,939 A * 2/1969 Young ..... B65D 1/40 220/609
3,831,797 A * 8/1974 Stevens, Jr. ..... B65D 50/066 215/216
3,838,789 A * 10/1974 Cvacho ..... B65D 25/24 220/630

(Continued)

*Primary Examiner* — Gloria R Weeks

(74) *Attorney, Agent, or Firm* — Norton Rose Fulbright Canada LLP

(57) ABSTRACT

A container comprises a monolithic plastic body having a lateral wall forming a tubular portion of the plastic container and a bottom edge portion for resting the plastic container on a ground. A bottom wall is at a bottom portion of the plastic container. The bottom wall us spaced apart from a plane of the bottom edge portion, the bottom wall and the lateral wall concurrently forming a receiving cavity of the plastic container. The bottom wall has a wall thickness between 30-50% of a wall thickness of the lateral wall. A hinge is at a junction of the bottom wall with a remainder of the container.

16 Claims, 2 Drawing Sheets

(56) References Cited

U.S. PATENT DOCUMENTS 3,905,507 A * 9/1975 Lyu ..... B65D 1/165 220/608
3,973,693 A * 8/1976 Brocklehurst ..... B65D 1/265 220/604
4,037,752 A * 7/1977 Dulmaine ..... B21D 51/26 220/606
4,125,218 A 11/1978 DeBoer
4,134,510 A * 1/1979 Chang ..... B29C 49/541 215/373
4,301,937 A * 11/1981 Von Hagel ..... B65D 41/3404 215/252
4,381,061 A * 4/1983 Cerny ..... B65D 1/12 215/12.2
RE31,496 E * 1/1984 Keeler ..... B65D 41/3423 215/252
4,542,029 A * 9/1985 Caner ..... B65B 7/2878 206/519
4,553,693 A * 11/1985 Terajima ..... B65D 75/5894 229/75
4,577,775 A * 3/1986 Kresin ..... B65D 1/265 220/604
4,762,514 A * 8/1988 Yoshida ..... B29C 59/007 219/121.67
5,000,338 A * 3/1991 Wolman ..... B65D 25/50 220/718
5,921,167 A * 7/1999 Giesy ..... B65D 83/0005 222/327
5,941,642 A * 8/1999 Darmstadter ..... B65D 77/283 383/104
6,176,069 B1 1/2001 Kossendrup
6,220,756 B1 * 4/2001 Darmstadter ..... B65D 75/5811 383/104
6,948,630 B2 * 9/2005 Julian ..... B65D 1/023 215/232
6,983,858 B2 * 1/2006 Slat ..... B65D 1/0276 215/373
8,127,955 B2 * 3/2012 Denner ..... B65D 79/005 215/373
8,276,774 B2 * 10/2012 Patcheak ..... B65D 1/0276 215/371
8,444,002 B2 * 5/2013 Schneider ..... B29C 49/541 220/606
8,584,879 B2 * 11/2013 Melrose ..... B29C 49/06 215/373
8,962,114 B2 * 2/2015 Nahill ..... B29B 11/14 428/35.7
9,027,783 B2 * 5/2015 Houlton ..... B65D 1/26 220/609
9,150,320 B2 * 10/2015 Wurster ..... B65D 1/0276
9,169,047 B2 * 10/2015 Savenok ..... B65D 1/265
9,346,611 B1 * 5/2016 Roberts ..... B65D 85/72
9,358,739 B2 * 6/2016 Tsuchiya ..... B65D 1/0261
9,394,072 B2 * 7/2016 Patcheak ..... B65D 1/0276
9,492,985 B2 * 11/2016 Marshall ..... B31F 1/0038
9,527,620 B2 * 12/2016 Dart ..... B65D 1/265
9,624,018 B2 * 4/2017 Melrose ..... B65D 1/0276
9,751,679 B2 * 9/2017 Stelzer ..... B65D 79/005
9,845,177 B1 * 12/2017 Goodson ..... B65D 25/2897
10,017,314 B2 * 7/2018 Swenson ..... B65D 1/12
10,543,121 B2 * 1/2020 Labombarbe ..... B65D 1/08
10,696,432 B2 * 6/2020 Levy ..... A47G 19/00
2004/0149677 A1 * 8/2004 Slat ..... B65D 1/0276 215/380
2007/0084821 A1 * 4/2007 Bysick ..... B65D 1/0276 215/373
2008/0047964 A1 * 2/2008 Denner ..... B29C 49/06 220/624
2008/0233252 A1 * 9/2008 Manning ..... B65D 33/2533 426/412
2011/0017700 A1 * 1/2011 Patcheak ..... B65D 1/0276 215/381
2011/0308977 A1 * 12/2011 DiLiberto ..... B65D 81/3272 206/222
2012/0325828 A1 * 12/2012 Houlton ..... B65D 79/005 220/600
2013/0043209 A1 * 2/2013 Wurster ..... B65D 1/0276 215/379
2014/0061211 A1 * 3/2014 Patcheak ..... B65D 1/0207 220/609
2014/0069937 A1 * 3/2014 Melrose ..... B65D 79/005 220/609
2014/0272020 A1 * 9/2014 Wilson ..... B65D 21/0233 426/115

* cited by examiner

ANTI-DEPRESSION PLASTIC CONTAINER

CROSS-REFERENCE TO RELATED APPLICATIONS

The present application claims the priority of U.S. Provisional Application No. 62/032,075, filed on Aug. 1, 2015, and incorporated herein by reference.

TECHNICAL FIELD

The present application relates to plastic containers used for foodstuff, among other uses.

BACKGROUND OF THE ART

Plastic containers are commonly used as packaging for foodstuff or other contents needing refrigeration. Indeed, plastic is a popular packaging material due to its relatively low price, and capacity to absorb shocks by the resilient nature of plastic, comparatively to glass or metal. Moreover, plastic containers may be sealed shut to form a waterproof and airproof chamber.

However, the resilient nature of plastic material may cause problems in some circumstances. For instance, it is known that increases in temperature may have an impact on the volume of a closed container, according to the ideal gas law (PV=nRT). Therefore, when a container is filled with a warm content and subsequently sealed closed, a change of temperature may result in a deformation of the plastic container. Likewise, a change in altitude may result in a pressure differential between the interior of the container and the environment of the container, thereby resulting in deformations of a plastic container. As containers are often stacked for transportation or shelving, the deformation of plastic containers may have dire effects.

SUMMARY

It is an aim of the present disclosure to provide a plastic container that addresses issues associated with the prior art.

Therefore, in accordance with the present disclosure, there is provided a container comprising: a monolithic plastic body having a lateral wall forming a tubular portion of the plastic container and a bottom edge portion for resting the plastic container on a ground, a bottom wall at a bottom portion of the plastic container, the bottom wall being spaced apart from a plane of the bottom edge portion, the bottom wall and the lateral wall concurrently forming a receiving cavity of the plastic container, the bottom wall having a wall thickness between 30-50% of a wall thickness of the lateral wall, and a hinge at a junction of the bottom wall with a remainder of the container.

Further in accordance with the present disclosure, there is provided a method for a plastic container to adapt to a pressure differential comprising: being sealed shut with a content to define a closed cavity; deforming at a bottom wall to change a volume of the closed cavity as a function of a pressure differential, a resulting deformation of the bottom wall not extending below a plane of a bottom edge portion lying against a ground; and simultaneously while deforming at the bottom wall, not substantially deforming at a lateral wall and lid.

DETAILED DESCRIPTION

Figure 1:
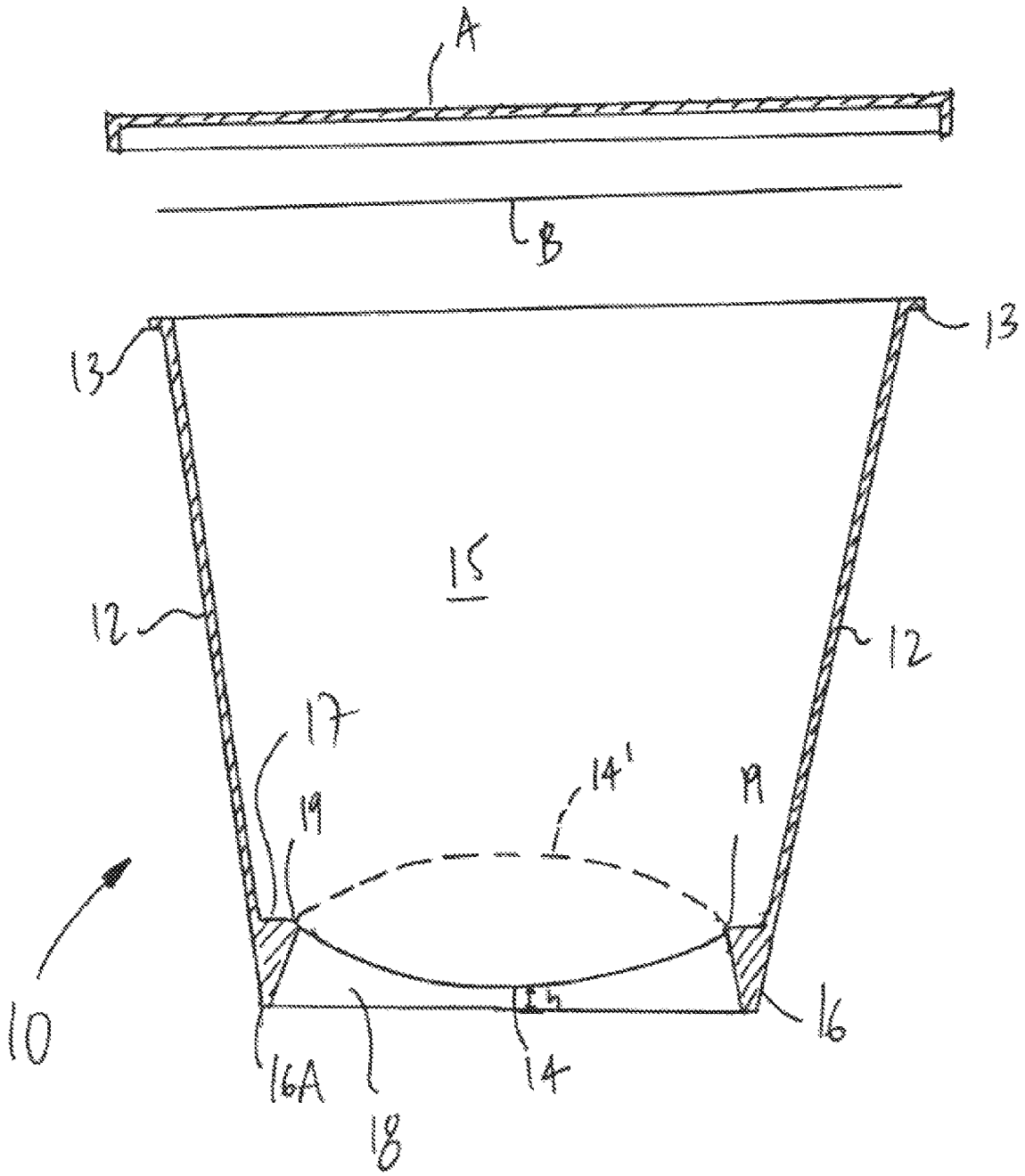
FIG. 1 is a schematic section view of an anti-depression plastic container in accordance with the present disclosure.

Referring to FIG. 1, there is illustrated an anti-depression plastic container 10 in accordance with the present disclosure. The container 10 is typically used for foodstuff, but may also be used in different circumstances to hold non-foodstuff liquids and/or solids, for example of the type necessitating refrigeration. The container 10 is typically sealed shut or closed once filled with its content, by a lid or cover A and/or by a sealing membrane B. The lid A is releasably connectable to a top open end 11 of the container 10. Tamper-proof configurations may be provided in the lid A, along with other possible configurations. However, for simplicity, the lid A is shown as being relatively flat, with a downwardly projecting rim for being connected to the container 10. The sealing membrane B is typically glued to a rim at the top open end 11 of the container 10. The sealing membrane B forms a barrier sealingly isolating the content of the container 10 from the surrounding environment. The membrane B is typically airproof and waterproof, and may be a plastic, a metallic foil, etc.

The container 10 comprises a lateral wall 12. The lateral wall 12 is tubular in shape, and is shown as having an inverted frusto-conical shape, with a circular cross-section. Other shapes and cross-sections are considered as well, such as a cylindrical shape, for the lateral wall 12. However, the frusto-conical shape is well suited for the ejection of the container 10 from a mold. A flange 13 is provided at the top rim of the lateral wall 12 and is one of the multiple configurations considered to provide gripping for the lid A, by which the lid A is secured to the container 10 to close the top open end 11.

A bottom wall 14 is generally transversally positioned relative to the lateral wall 12. The bottom wall 14 and the lateral wall 12 concurrently define the inner cavity 15 in which a content of the container 10 will be received. It is observed from FIG. 1 that the bottom wall 14 is concave relative to the inner cavity 15, i.e., the bottom wall 14 forms a concavity. There is also shown in stippled lines that the bottom wall 14 may be convex relative to the inner cavity 15, i.e., to form a convexity. The concavity or convexity of the bottom wall 14 will be dependent on the contemplated use and filling conditions of the container 10, as will be described hereinafter. The concavity or convexity may be defined as a dome shape, or a frusto hemispherical shape.

Figure 2:
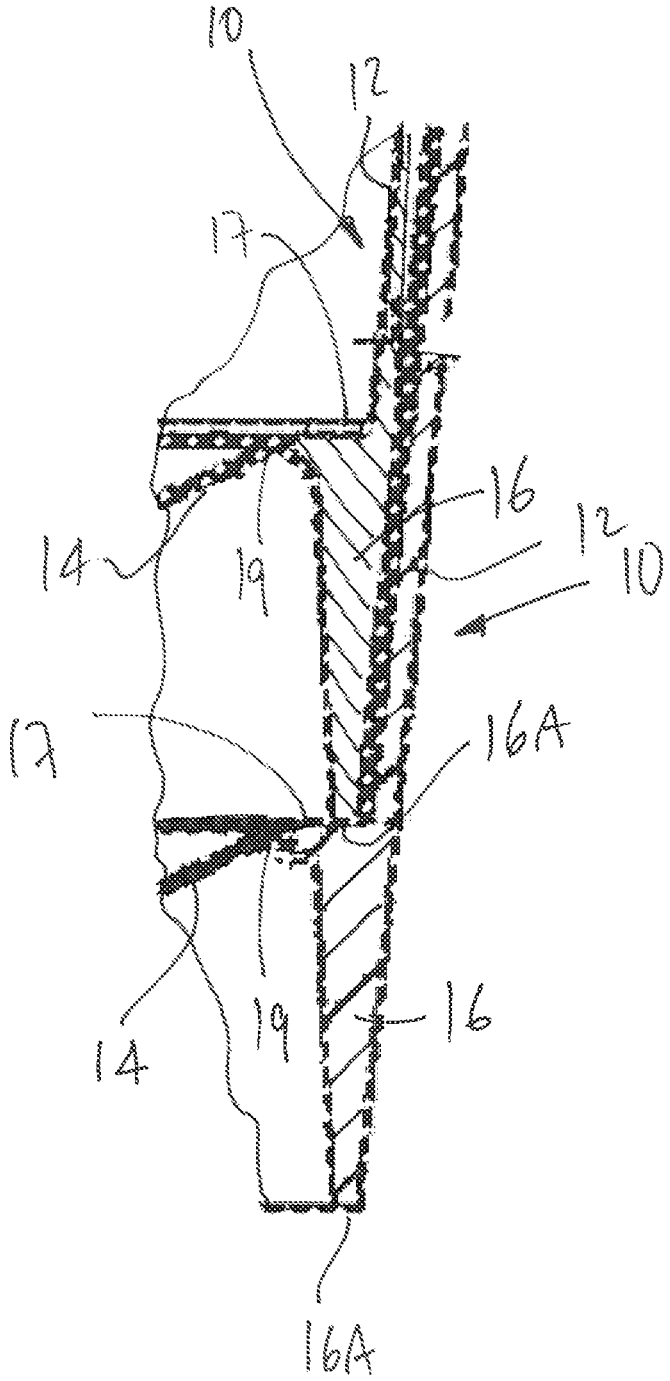
FIG. 2 is an enlarged section view of an empty pair of the anti-depression plastic container nested into one another.

A support base 16 is part of the lateral wall 12, and projects downwardly at the bottom of the container 10. In the illustrated embodiment, the support base 16 is a continuation of the lateral wall 12 in terms of forming the outer surface of the container 10, which may be a continuous smooth surface, up to the flange 13 (i.e., least the midline). In looking closely, a section of the support base 16 may be thicker than the lateral wall 12, i.e., an enlarged portion. FIG. 1 shows a tapering shape, although other shapes are considered as well. The tapering shape provides structural integrity to the support base 16, as the support base 16 is the interface of the container 10 with the ground, by way of its bottom edge portion 16A upon which it lies on the ground. Moreover, the support base 16 may define a support shoulder or circumferential surface 17, which support surface 17 serves as a stop and support when two empty containers are nested one into the other, as shown in FIG. 2.

It is observed that the support base 16 spaces an underside of the bottom wall 14 at a minimum height h from the ground. A clearance volume 18 is defined between the ground, inner surface of the support base 16 and an undersurface of the bottom wall 14. A hinge 19 is formed at the junction between the lateral wall 12 or the support base 16, and the bottom wall 14. The hinge 19 substantially lies in a plane, unlike the bottom wall 14 that is convex or concave, i.e., non-planar. The hinge 19 is spaced apart from the ground by the support base 16. Alternatively, the bottom wall 14 may have an initial or final planar shape, before or after deformation as mentioned below.

The container 10 in an embodiment is an integrally molded monolithic piece, with the components 12-19 monolithically part of the container 10. The material used for the molding of the container 10 is a polymeric resin, such as polypropylene or polyethylene. If foodstuff is to fill the container 10, the resins used are foodgrade resins, with appropriate precautions taken during molding to ensure that the container 10 meets food regulations.

As observed in FIG. 1, a thickness of the lateral wall 12 is greater than a thickness of the bottom wall 14. The thickness of the bottom wall 14 is only from 30 to 50% of a thickness of the lateral wall 12. For example, if the thickness of the lateral wall is 1.0 mm, the thickness of the bottom wall 14 is between 0.3 and 0.5 mm. The thickness of the hinge 19 may also be within the same thickness range as the bottom wall 14. Accordingly, as these walls 12 and 14 are made of the same material—they are integrally molded into a monolithic piece—, the greater thickness of the lateral wall 12 relative to that of the bottom wall 14 will provide greater structural integrity to the lateral wall 12. The bottom wall 14 will deform prior to the wall 12 in the occurrence of a pressure differential between the sealed interior of the container 10 and the surrounding environment of the container 10.

The container 10 may be molded with the bottom wall 14 forming a concavity relative to the inner cavity 15 in anticipation of a positive pressure differential between the exterior of the sealed container 10 and the interior of the sealed container 10. A positive pressure differential occurs when the exterior pressure (e.g., atmospheric pressure) is greater than the interior pressure of the sealed interior of the container 10. For example, if the container 10 is filled with its content and sealed shut at altitude and the container 10 is subsequently brought to a lower altitude, there may result a positive pressure differential, as the atmospheric pressure lowers for an increasing altitude. Hence, in anticipation of a positive pressure differential (for example because of geographic considerations), the container 10 may be molded with the concavity configuration of the bottom wall 14. When the positive pressure differential occurs, the bottom wall 14 will deform to reach the convexity shape 14', using the hinge 19 for facilitating the deformation. In the process, the pressure in the sealed container 10 will increase as the displacement of the bottom wall 14 to the convexity shape 14' will reduce the volume of the sealed container 10 (according to the ideal gas law).

Another occurrence of positive pressure differential is the instance in which the container 10 is filled and sealed with a warm content. Upon cooling of the content and the ensuing temperature drop, a pressure inside the container 10 may drop, urging the container 10 to change volume. In both these situations, the bottom wall 14 may plastically deform to adopt the convex shape 14'.

On the other hand, if the container 10 being sealed shut undergoes a negative pressure differential, by having its internal pressure greater than the ambient pressure, the container 10 will tend toward an increase in volume. In anticipation of such a situation, the container 10 may be molded with the convex bottom wall 14', so as to enable the plastic deformation that will cause the bottom wall to reach the concave shape 14.

Although the container 10 is described as being molded with either the concavity of the bottom wall 14, or convexity 14', it is considered to mold the container 10 with the concavity of the bottom wall 14, to then manually deform the bottom wall 14 to reach the convexity 14', or vice versa. Hence, a same mold could be used to mold the container 10 in prevision of a positive or a negative pressure differential.

The close proximity between the lid A and membrane B limits the deformation of the membrane B. For this purpose, the thickness of the lid A may be equivalent or of a similar magnitude as the lateral wall 14, comparatively to that of the bottom wall 14 and hinge 19. The radius of the concavity and convexity may be selected as a function of anticipated pressure differential, taking into account the ideal gas law. The support base 16 is selected to have a sufficient height to allow the deformation described above.

Accordingly, the plastic container 10 adapts to a pressure differential after being sealed shut with a content to define a closed cavity, by deforming solely at the bottom wall 14, and not at the lateral wall 12 (the membrane B not being part of the monolithic container 10), to change a volume of the closed cavity 15 as a function of a pressure differential, a resulting deformation of the bottom wall 14 not extending below a plane of a bottom edge portion 16B lying against the ground, leaving height h. Simultaneously while deforming at the bottom wall 14, the container 10 does not substantially deform at a lateral wall 12 and lid A, i.e., the lateral wall 12 and the lid A preserve their shape, and any deformation is negligible in comparison to the deformation of the bottom wall 14. Depending on the circumstances, the deforming at the bottom wall 14 may result in deforming from a concave shape in the closed cavity 15 to a convex shape in the closed cavity 15, or vice-versa. In an embodiment, the deforming is between a frusto-spherical concave shape and a frusto-spherical convex shape. The deforming may result from being exposed to a change in altitude after being sealed shut. The deforming may also result from being exposed to a temperature change after being sealed shut.

The invention claimed is:

1. A container comprising:

a monolithic plastic body having a lateral wall forming a tubular portion of the plastic container and extending from a top edge portion to a bottom edge portion for resting the plastic container on a ground, a bottom wall at a bottom portion of the plastic body of the container, the bottom wall being spaced apart from a plane of the bottom edge portion, the bottom wall and the lateral wall concurrently forming a receiving cavity of the plastic body of the container, a substantial portion of the bottom wall having a wall thickness between 30-50% of a wall thickness of the lateral wall, and a hinge at a junction of the bottom wall with the bottom portion of the container, whereby the bottom wall is deformable between a convex shape relative to the receiving cavity, and a concave shape relative to the receiving cavity, a portion of the lateral wall projecting downwardly from the junction of the bottom wall with the bottom portion of the container whereby the bottom wall is spaced apart from the plane of the bottom edge portion in the convex shape and in the concave shape.

2. The container according to claim 1, wherein the bottom wall is molded in a non-planar shape.

3. The container according to claim 2, wherein the bottom wall is molded in a frusto-spherical shape.

4. The container according to claim 2, wherein the bottom wall is molded into a concave shape relative to the receiving cavity.

5. The container according to claim 1, further comprising an enlarged portion formed at said junction between the lateral wall and the bottom wall.

6. The container according to claim 5, wherein the enlarged portion in the lateral wall extends from the hinge to the bottom edge portion.

7. The container according to claim 5, wherein the enlarged portion has a downward taper shape.

8. The container according to claim 5, wherein the lateral wall has a continuous smooth outer surface from the bottom edge portion to at least a midline of the container.

9. The container according to claim 5, wherein the enlarged portion forms a circumferential support surface facing upwardly in the receiving cavity for nesting a first one of the container into an empty second one of the container.

10. The container according to claim 1, wherein the monolithic plastic body is made of polypropylene and polyethylene.

11. An assembly comprising:

the container as in claim 1;

a lid releasably connectable to the container to close a top open end of the container, the bottom wall having a wall thickness between 30-50% of a wall thickness of the lid.

12. The container of claim 1, wherein a center portion of the bottom wall is movable from a position below a plane containing the hinge when the bottom wall in in the concave shape relative to the receiving cavity to a position above the plane containing the hinge when the bottom wall is in the convex shape relative to the receiving cavity.

13. The container of claim 1, wherein an entirety of the bottom wall defines the convex shape and the concave shape.

14. The container of claim 1, wherein the substantial portion of the bottom wall having a wall thickness between 30-50% of the wall thickness of the lateral wall includes a central portion of the bottom wall, the central portion of the bottom wall connected to the hinge via an annular portion of the bottom wall extending around the central portion.

15. The container of claim 1, wherein the wall thickness of the lateral wall is a first wall thickness, the lateral wall having a second wall thickness greater than the first wall thickness at the portion of the lateral wall.

16. The container of claim 15, comprising an enlarged portion formed at the junction between the lateral wall and the bottom wall, the enlarged portion defined by a change of a thickness of the lateral wall from the first wall thickness to the second wall thickness.

* * * * *